US011331874B2

(12) United States Patent
Sand

(10) Patent No.: US 11,331,874 B2
(45) Date of Patent: May 17, 2022

(54) RIM FLATTENER APPARATUS AND METHOD

(71) Applicant: Paper Machinery Corporation, Milwaukee, WI (US)

(72) Inventor: Dale L. Sand, Hubertus, WI (US)

(73) Assignee: Paper Machinery Corporation, Milwaukee, WI (US)

( * ) Notice: Subject to any disclaimer, the term of this patent is extended or adjusted under 35 U.S.C. 154(b) by 603 days.

(21) Appl. No.: 15/332,467

(22) Filed: Oct. 24, 2016

(65) Prior Publication Data

US 2018/0111346 A1 Apr. 26, 2018

(51) Int. Cl.
*B31F 1/00* (2006.01)
*B31B 50/25* (2017.01)
(Continued)

(52) U.S. Cl.
CPC ..... *B31F 1/0038* (2013.01); *B31B 50/00* (2017.08); *B31B 50/25* (2017.08); *B31B 50/28* (2017.08);
(Continued)

(58) Field of Classification Search
CPC .... B31F 1/0038; B31F 1/0035; B31F 1/0077; B31F 1/0087; B31B 50/00; B31B 50/25; B31B 50/59; B31B 50/81; B31B 50/28; B31B 50/594; B31B 2105/00; B31B 2110/20; B31B 2100/00; B31B 2120/002; B31B 2105/0022; B31B 50/592
(Continued)

(56) References Cited

U.S. PATENT DOCUMENTS 2,778,287 A * 1/1957 Moore ..... B31F 1/0087 425/393
3,027,815 A * 4/1962 Anness ..... B31B 50/00 493/27
(Continued)

FOREIGN PATENT DOCUMENTS

EP 0695692 A2 2/1996

OTHER PUBLICATIONS

International Search Report and Written Opinion for International Application No. PCT/US2017/047270 dated Jan. 22, 2018.
(Continued)

*Primary Examiner* — Sameh Tawfik
(74) *Attorney, Agent, or Firm* — Andrus Intellectual Property Law, LLP

(57) ABSTRACT

An apparatus for forming an upper edge of a paperboard container includes a pocket including a shell having a cavity with a mouth configured to receive the container along an axis such that the rim extends beyond the mouth. A workstation includes a forming member having a first forming surface which is actuatable toward the axis from a retracted position spaced from the rim to an extended position lying adjacent an upper end of the rim, and a forming segment having a second forming surface which is actuatable along the axis and the forming member in response to axial movement thereof such that the second forming surface is positioned spaced from a lower end of the rim. The second forming surface is actuatable along the axis towards the first forming surface to form the rim therebetween.

5 Claims, 16 Drawing Sheets

(51) Int. Cl.

| | |
|---|---|
| ***B31B 50/81*** | (2017.01) |
| ***B31B 50/59*** | (2017.01) |
| ***B31B 50/28*** | (2017.01) |
| ***B31B 50/00*** | (2017.01) |
| *B31B 105/00* | (2017.01) |
| *B31B 120/00* | (2017.01) |
| *B31B 100/00* | (2017.01) |
| *B31B 110/20* | (2017.01) |

(52) U.S. Cl.
CPC ..... *B31B 50/59* (2017.08); *B31B 50/594* (2018.05); *B31B 50/81* (2017.08); *B31F 1/0035* (2013.01); *B31F 1/0077* (2013.01); *B31F 1/0087* (2013.01); *B31B 50/592* (2018.05); *B31B 2100/00* (2017.08); *B31B 2105/00* (2017.08); *B31B 2105/0022* (2017.08); *B31B 2110/20* (2017.08); *B31B 2120/002* (2017.08)

(58) Field of Classification Search
USPC ..... 493/459
See application file for complete search history.

(56) References Cited

U.S. PATENT DOCUMENTS 3,065,677 A 11/1962 Loeser
3,461,642 A * 8/1969 Jacobus ..... B65B 5/024 53/456
3,800,502 A * 4/1974 Vermeulen ..... B29C 65/48 53/329.2
3,933,298 A * 1/1976 Ellerbrock ..... B65D 15/06 229/5.6
4,281,979 A * 8/1981 Doherty ..... B29C 57/12 264/230
4,349,345 A * 9/1982 Bodendoerfer ..... B31B 50/324 493/295
4,680,016 A * 7/1987 Lynch ..... B31F 1/0038 425/394
5,026,338 A * 6/1991 Blackwelder ..... B29C 57/12 264/322
5,167,607 A * 12/1992 Larsen ..... B31B 50/00 493/183
5,431,619 A * 7/1995 Bacon ..... B21D 19/12 493/158
5,460,591 A * 10/1995 Sand ..... B31B 1/86 156/521
5,637,332 A * 6/1997 Ridout ..... B31F 1/008 425/356
5,769,311 A 6/1998 Morita et al.
5,806,289 A * 9/1998 Sassi ..... B65B 19/24 493/163
6,120,426 A * 9/2000 Bacon ..... B29C 57/12 413/71
6,195,959 B1 * 3/2001 Tisma ..... B65B 5/024 493/139
6,641,515 B2 * 11/2003 Ferri ..... B31F 1/0077 493/158
6,722,104 B1 * 4/2004 Haggman ..... B65B 3/027 53/412
7,454,879 B2 * 11/2008 Boldrini ..... B65B 39/145 53/378.3
8,603,276 B2 * 12/2013 Riethmueller ..... B65D 3/22 156/191
8,671,730 B2 * 3/2014 Ytsma ..... B21D 51/2615 72/348
8,852,493 B2 * 10/2014 Rasanen ..... B29C 53/34 264/295
2002/0111260 A1 * 8/2002 Sand ..... B31F 1/0038 493/51
2006/0237465 A1 * 10/2006 D'Amato ..... B65D 81/3869 220/592.27
2008/0280743 A1 * 11/2008 Stahlecker ..... B65D 3/22 493/106

OTHER PUBLICATIONS

International Preliminary Search Report and Written Opinion for International Application No. PCT/US2017/047270 dated May 9, 2019.

* cited by examiner

RIM FLATTENER APPARATUS AND METHOD

FIELD OF THE INVENTION

The present invention relates generally to the field of machines that form rims of containers. In particular, the present invention relates to the field of a single machine rim curling and rim flattening device.

BACKGROUND OF THE INVENTION

Rims of containers are often curled to provide the container with a smooth and stronger upper edge. However, curled upper edges provide only a limited amount of surface area (the crown) against which the sealing panel may be secured. As a result, the curls are often flattened to provide a larger surface area against which a sealing panel may be secured. The flattened curl itself is also sealed as a result of the typical thermosplastic coating being melted as the curl is flattened.

Two apparatus are commonly used to curl and flatten the upper edges of paperboard containers. These apparatuses include a two-machine apparatus and a single machine apparatus. A conventional two-machine apparatus generally includes a pocket having an upper perimeter bounded by a concave groove or semi-spherical groove. To curl the rim, a series of tools that have a concave groove or semi-spherical groove are linearly moved towards the pocket so as to deform and curl the upper edge of the paperboard container. The paperboard container is then removed and loaded on to a second flattening machine having a pocket bounded by a flat surface and having a die ring providing an opposing flat surface. The die ring is linearly moved towards the flat surface of the pocket to flatten the curl therebetween. Although conventional, this two-machine apparatus is expensive, space consuming and slow.

A conventional single machine employs a pocket and die ring similar to the pocket and die ring employed by the two-machine process for curling the upper edge of the paperboard container. However, instead of requiring that the paperboard container with a curled rim be removed and reloaded on a separate machine for flattening, the single machine has a series of two heating stations, two curling stations and a flattening station where the machine lifts the container out of the pocket and into the flattener station as four flattening anvils are extended towards one another and about the container under the rim to form a solid ring. A generally flat member is then moved against the anvils to compress and flatten the curled rim therebetween. The order of operation is then reversed to discharge the cup. Although eliminating the need for two separate machines to curl and flatten the paperboard upper edge, such single machine apparatus are still slow since the flattening step requires that the cup be raised and lowered relative to the pocket and also requires that four flattening anvils be extended toward the rim and retracted away from the rim. These additional steps increase process time and costs. The requirement of four stations to rim the container also adds complexity and cost to the machine.

A machine and a method for forming a rim of a paperboard container having a bottom and a sidewall terminating at a rim are disclosed in U.S. Patent Application Publication No. 2002/0111260 published Aug. 15, 2002, the disclosure of which is herein incorporated by reference in entirety. The machine includes a frame, a turret rotatably coupled to the frame, a plurality of circumferentially spaced pockets supported by the turret and a plurality of workstations about the turret. Each pocket includes a shell having a cavity with a mouth configured to receive the container along an axis and a first member about the cavity and including a first surface. The first surface is one of a flat surface and a concave surface and is actuatable along the axis from a retracted position below the mouth to an extended position adjacent the mouth. The plurality of workstations includes a first station and a second station. The first station has a first tool with a second surface, wherein the second surface is one of a flat surface and a concave surface. The first tool is adapted to move along the axis so as to engage and form the paperboard rim between the first and second surfaces. The second station includes a second tool having a third surface, wherein the third surface is the other of a flat surface and a concave surface. The second station further includes a plurality of die segments about the second tool. Each segment has a fourth surface, wherein the fourth surface is the other of a flat surface and a concave surface. The die segments are adapted to move along the axis and to pivot between a closed position in which the fourth surface engages and forms a rim and an opened position.

SUMMARY OF THE INVENTION

One embodiment of the invention relates to an apparatus for forming an upper edge of a paperboard container having a bottom and a sidewall terminating at a rim at the upper edge. The apparatus includes a pocket having a shell provided with a cavity with a mouth configured to receive the container along an axis such that the rim extends beyond the mouth. A workstation includes a forming member separate from the pocket having a first forming surface being one of a flat surface and a concave surface. The first forming surface is actuatable along the axis from a retracted position spaced from the rim to an extended position lying adjacent an upper end of the rim. A forming segment has a second forming surface being one of a flat surface and a concave surface. The forming segment is actuatable towards the axis and the forming member in response to axial movement thereof such that the second forming surface is positioned spaced from a lower end of the rim. The second forming surface is actuatable along the axis towards the first forming surface to form the rim therebetween.

Another embodiment of the invention relates to an apparatus for forming an upper edge of a paperboard container having a bottom and a sidewall terminating at a rim. The apparatus includes a pocket having a shell provided with a cavity with a mouth configured to receive the container such that the rim extends beyond the mouth and the container is centered along an axis of the pocket, the rim being formed with a curl thereon. A flattening station is configured to provide compression and flattening of the curl formed on the rim. The flattening station includes a cam coupled to a forming member having a first forming surface. The cam and the forming member are movable back and forth relative to a support along the axis of the pocket. A set of forming arms is pivotally coupled to the support and is positioned outside the forming member for movement relative thereto. The forming arms are axially movable together with the cam and the forming member. Each of the forming arms has a cam follower engaged with the cam, and a forming segment having a second forming surface facing the first forming surface. The forming member is moved to position the first forming surface on an upper end of the curl on the rim, and the forming arms are pivoted to position each second forming surface spaced from a lower end of the curl on the rim in response to axial movement of the cam and the forming member, and each second forming surface is moved towards the first forming surface to form a flattened rim on the container.

Another embodiment of the invention relates to a method for forming an upper edge of a paperboard container including a bottom and a sidewall terminating in a rim. The method includes the steps of a) positioning the container in a pocket having a mouth such that the rim extends beyond the mouth and such that the container is centered along an axis; b) actuating a forming member having a first forming surface axially along the axis towards and adjacent an upper end of the rim; c) pivoting a forming segment having a second forming surface facing the first forming surface such that the second forming surface lies spaced from a lower end of the rim; and d) actuating at least one of the first forming surface and the second forming surface towards each other to form the rim therebetween.

An additional embodiment of the invention relates to a method of forming an upper edge of a paperboard container including a bottom and a sidewall terminating in a rim. The method includes the steps of a) providing a pocket including a shell having a cavity with a mouth configured to moveably receive the container such that the rim extends beyond the mouth and the container is centered along an axis of the pocket, the rim being formed with a curl thereon; b) providing a cam coupled to a forming member having a first forming surface, the cam and the forming member being axially moveable back and forth relative to a support along the axis of the pocket; c) providing a set of forming arms pivotally coupled to the support and positioned outside the forming member for movement relative thereto, each of the forming arms having a cam follower engaged with the cam, and a forming segment having a second forming surface facing the first forming surface; d) moving the container along the axis in the pocket to advance the rim towards the forming member; e) moving the forming member and each forming segment along the axis towards the pocket until each second forming surface is positioned outside of and beyond a lower end of the rim; f) further moving the forming member along the axis such that the first forming surface lies adjacent an upper end of the rim, such further movement of the forming member enabling each cam follower to move along the respective cam and causing the forming arms to pivot towards the axis and move the forming segments towards the forming member such that the second forming surfaces are positioned spaced from the lower end of the rim and in alignment with the first forming surface; and g) moving the second forming surfaces towards the first forming surface to flatten and compress the curl and form a flattened rim.

BRIEF DESCRIPTION OF THE DRAWINGS

The drawings illustrate the best mode presently contemplated of carrying out the disclosure. In the drawings.

DETAILED DESCRIPTION

Figure 1:
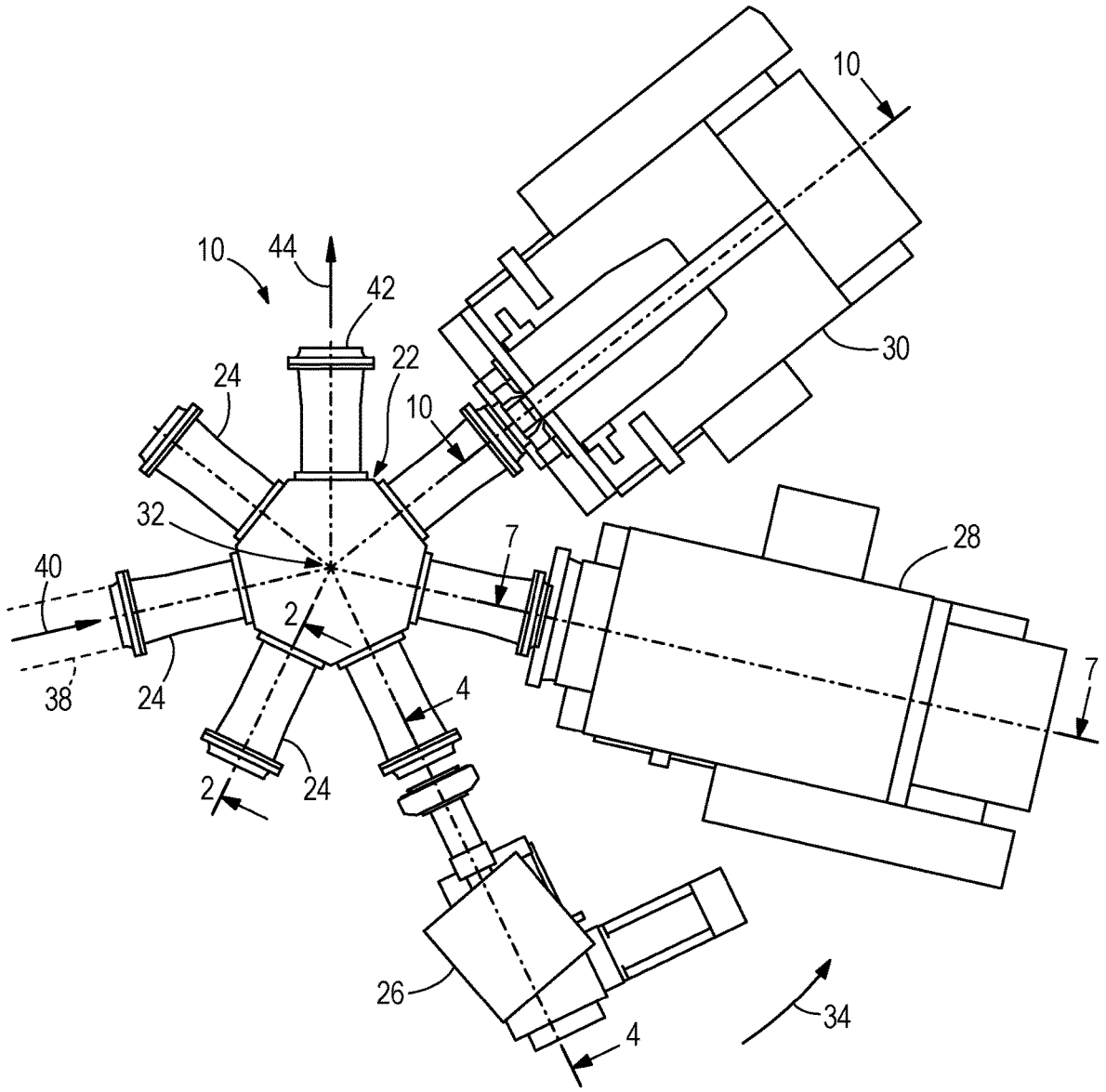
FIG. 1 is a top elevational view of a rim-forming apparatus of the present invention including a turret supporting a plurality of pockets, a heating station, a curling station, and a flattening station.

FIG. 1 is a top elevational view of paperboard rim forming apparatus 10 forming the rim of a paperboard container 12 (shown in FIG. 3) having a bottom 14 and a sidewall 16 terminating at a rim 18. Apparatus 10 generally includes turret 22, pockets 24, heating station 26, curling station 28, and flattening station 30. Turret 22 is conventionally known and is rotatably driven about axis 32 in the direction indicated by arrow 34 in a conventionally known manner to index and position pockets 24 sequentially between each of stations 26, 28 and 30.

Pockets 24 are coupled to turret 22 so as to be rotatably driven about axis 32 by turret 22. In the exemplary embodiment, apparatus 10 includes seven pockets 24 circumferentially and equidistantly spaced about turret 22. Alternatively, apparatus 10 may he provided with any of a number of pockets 24 depending upon the number of stations required to form rim 18 of container 12 as well as to possibly form additional portions of container 12. Pockets 24 are each configured to receive and carry an individual container 12 as apparatus 10 is forming container 12. As a result, rim 18 of container 12 may be formed in fewer steps, in less time and with simpler and less expensive equipment.

Heating station 26, curling station 28 and flattening station 30 are circumferentially positioned about turret 22 and pockets 24 and are configured to engage rim 18 of container 12 to form rim 18. In operation, containers 12 having unformed rims 18 are individually loaded into pockets 24 at loading station 38, as indicated by arrow 40. Turret 22 thereafter rotates to position container 12 across from heating station 26. Heating station 26 directs hot air at rim 18 to melt the thermoplastic coating on rim 18, to render it more pliable for deformation and to allow the flattened rim to seal. Turret 22 then rotates to position pocket 24 and its container 12 across from curling station 28. Curling station 28 forms rim 18 by curling rim 18. Turret 22 then rotates to position pocket 24 and its container 12 across from flattening station 30. Flattening station 30 further forms the curled rim 18 by compressing and flattening rim 18. Thereafter, turret 22 rotates to position pocket 24 and formed container 12 at discharge station 42 where container 12 and its completed rim 18 are ejected, such as by a blower, or otherwise removed from apparatus 10 as indicated by arrow 44.

Figure 2:
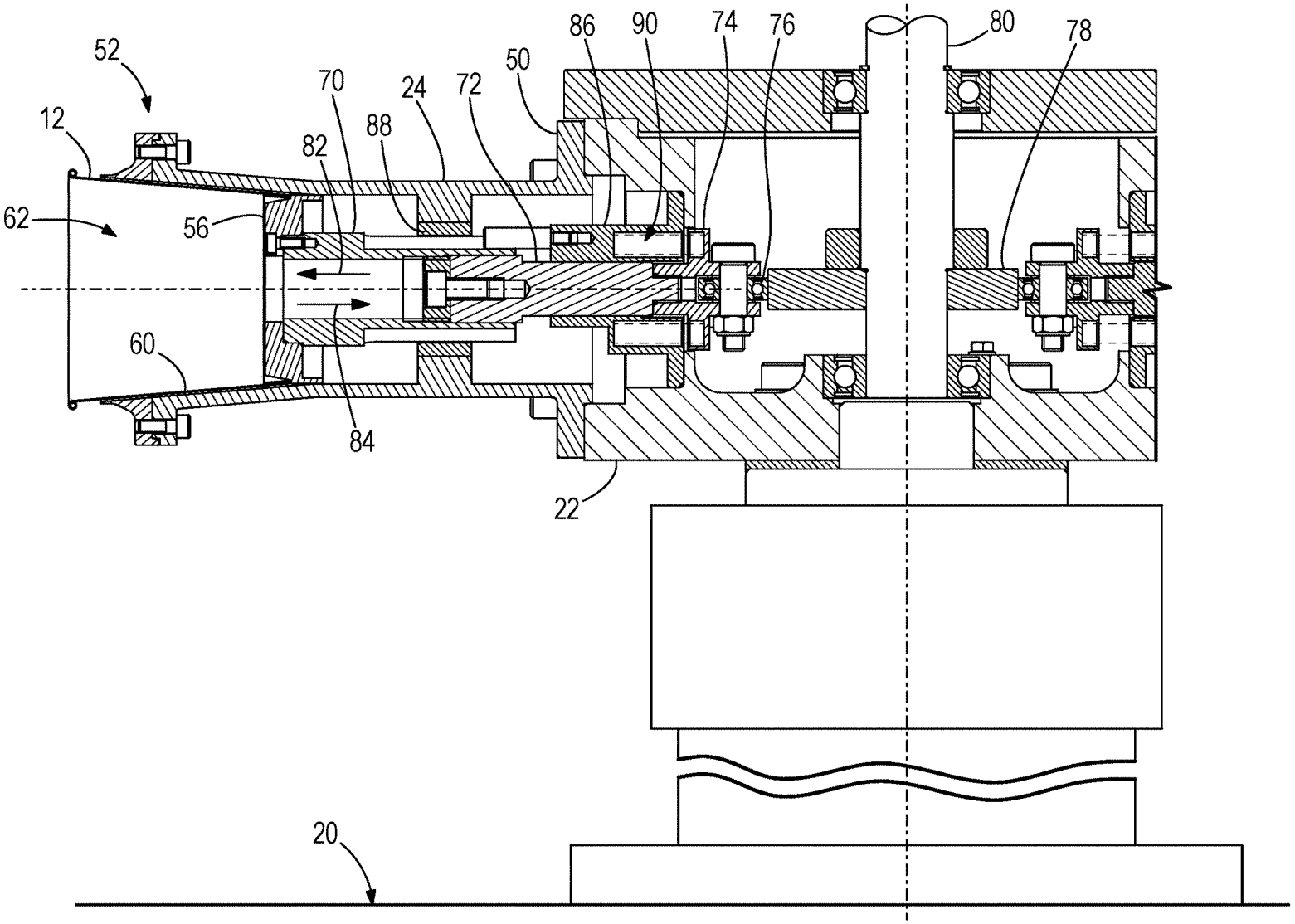
FIG. 2 is a sectional view of the turret and pocket of FIG. 1 taken along line 2-2.
Figure 3:
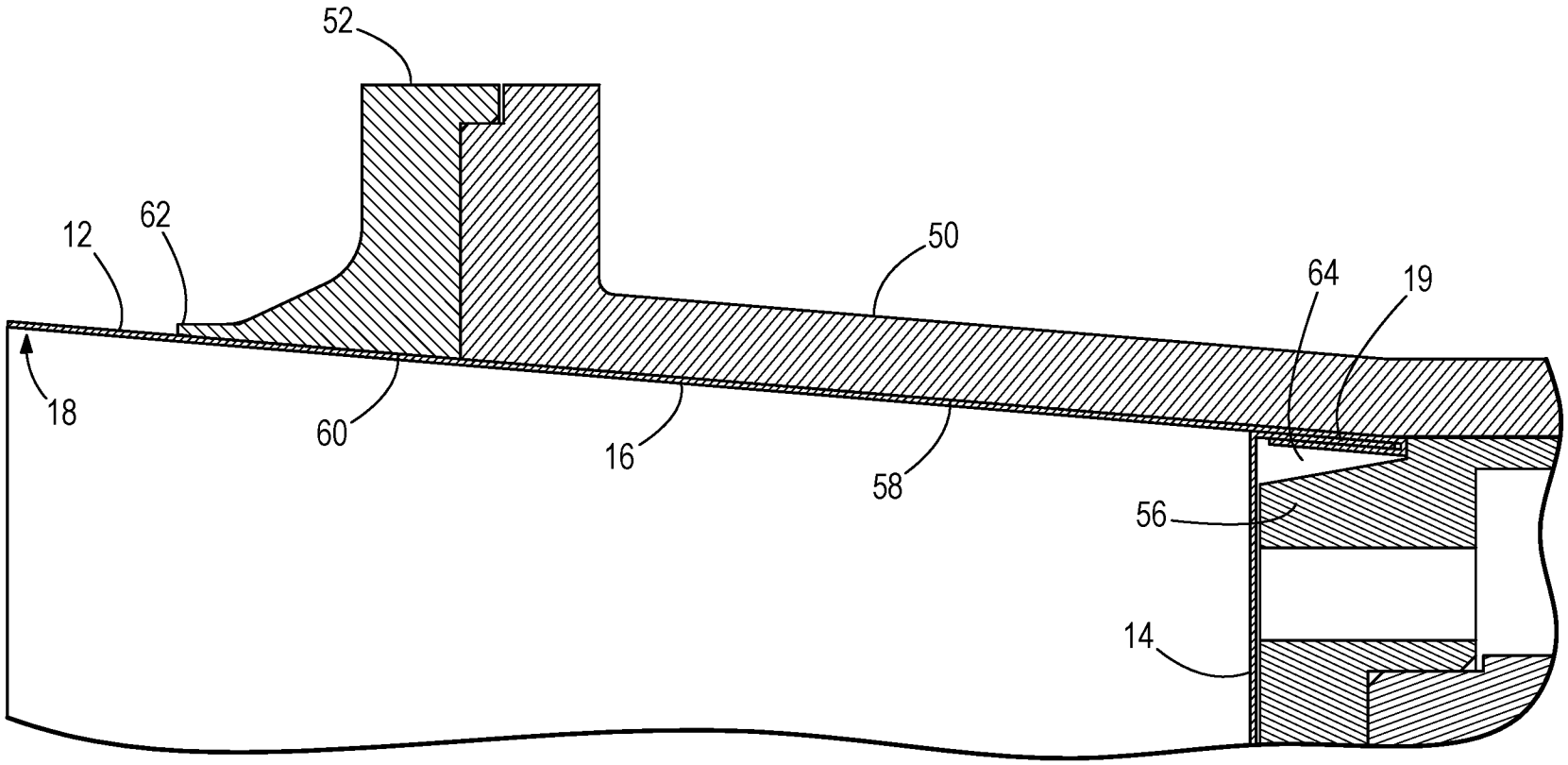
FIG. 3 is an enlarged fragmentary sectional view of a container positioned within the pocket of FIG. 2.

FIGS. 2-3 illustrate turret 22, pockets 24 and the loading of container 12 into each pocket 24 in greater detail. As shown by FIG. 2, each pocket 24 generally includes shell support 50, shell 52, bottom 56, supports 70, 72, 74 and cam follower 76. Turret 22 includes cam 78 and shaft 80. Shell support 50 mounts to turret 22 (shown in FIG. 2) and is configured for supporting shell 52. As will be appreciated, the exact configuration of shell support 50 may vary depending upon the configuration of turret 22 and of shell 52. Shaft 80 is fixedly coupled to a machine base 20. Cam 78 is eccentrically mounted upon shaft 80 and interacts with cam follower 76 to reciprocate cam follower 76 in the directions indicated by arrows 82 and 84 in a timed relationship with the rotation of turret 22, and supporting pockets 24.

Shell 52 is supported by shell support 50 and includes bottom 56 defining cavity 60. Cavity 60 forms a mouth 62 and is configured to receive container 12. As shown in FIG. 3, bottom 56 and sidewall 58 form an annular groove 64 configured to receive a lower bottom rim 19 of container 12. Alternatively, groove 64 may be omitted where container 12 lacks such a lower bottom rim 19. As further shown by FIG. 3, shell support 50 has a length extending beyond bottom 56 such that when container 12 is positioned within cavity 60, rim 18 projects above or generally beyond mouth 62. Preferably, pocket 24 should be configured such that rim 18 projects above mouth 62 by a sufficient distance for enabling rim 18 to be curled and flattened to produce the final container 12 shown in FIG. 13.

Cam follower 76 (as shown in FIG. 2) is coupled to support 74 which is in turn coupled to support 72. Support 72 is coupled to support 70 which is in turn coupled to bottom 56. In the exemplary embodiment, support 74 is mounted to support 72. Support 72 comprises an elongate cylinder slidably supported by bushing 86 relative to turret 22. Support 72 is mounted to support 70. Support 70 comprises an elongate cylinder slidably supported by bushing 88 relative to shell support 50. Springs 90 act against support 74 to maintain cam follower 76 against cam 78 during rotation of turret 22. The left-hand section of FIG. 2 illustrates bottom 56 being moved outward toward mouth 62 pushing container 12 out of the pocket 24 as a result of turret 22 rotating cam follower 76 against cam 78. As turret 22 continues to rotate, bottom 56 is retracted to a starting position. FIG. 2 illustrates an actuating mechanism for reciprocating the bottom member 56 for a purpose to be described hereafter.

Figure 4:
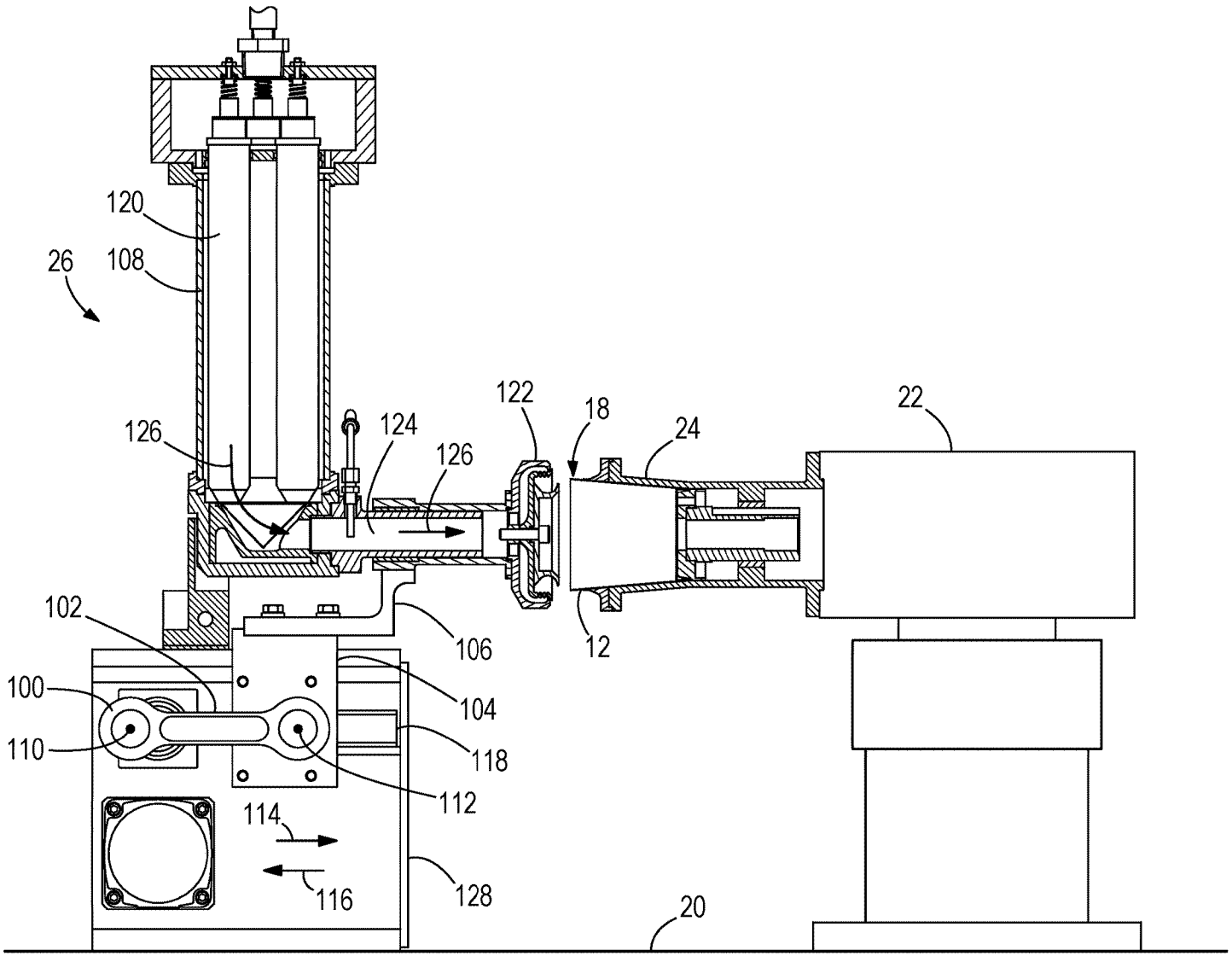
FIG. 4 is a sectional view of the heating station of FIG. 1 taken along line 4-4.
Figure 5:
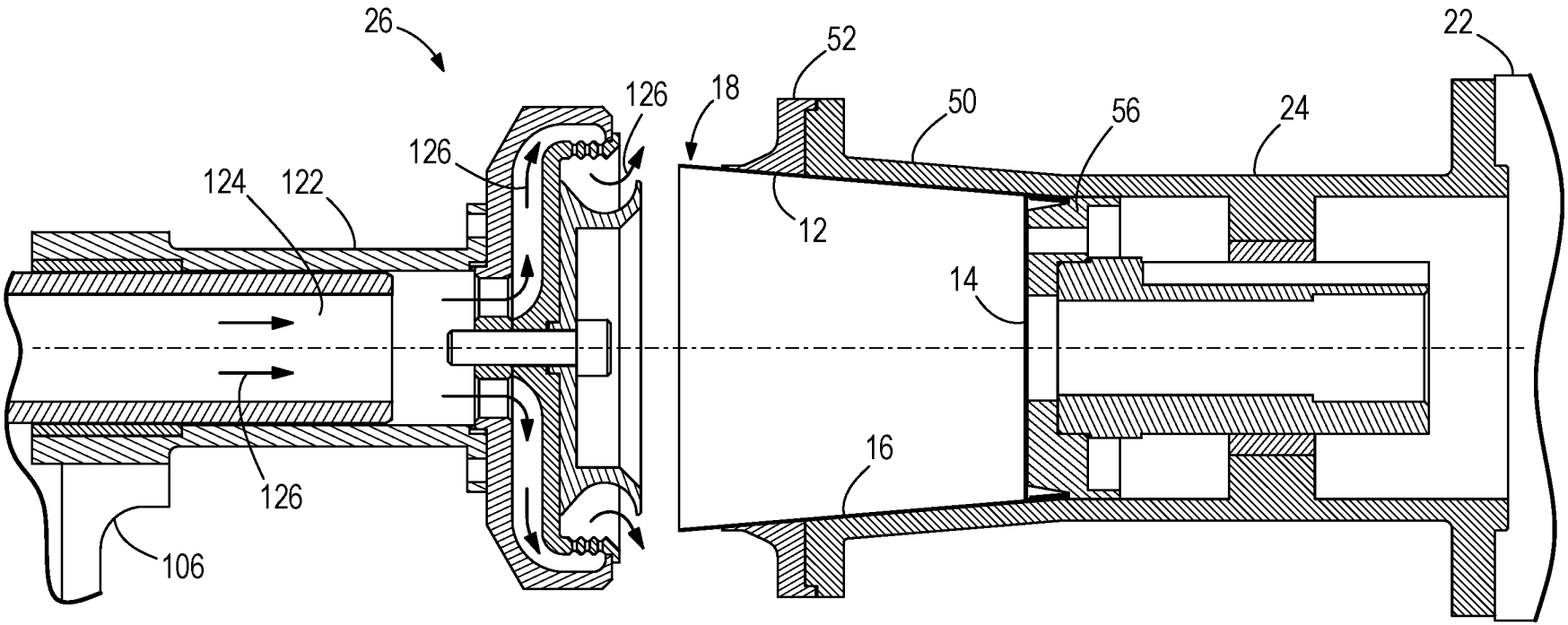
FIG. 5 is an enlarged fragmentary sectional view of the heating station of FIG. 4.

FIGS. 4-6 illustrate heating station 26 of apparatus 10 in greater detail. Heating station 26 is configured to heat rim 18 prior to rim 18 being curled and flattened. FIG. 4 illustrates turret 22 positioning pocket 24 carrying container 12 across from and opposite to heating station 26. As shown by FIG. 4, heating station 26 generally includes eccentric shaft 100, connecting link 102, support 104, nozzle support 106, heater assembly 108 and nozzle 122. Eccentric shaft 100 is rotatably supported within heating station 26 and is rotatably driven in the conventionally known manner by chains or belts.

Eccentric shaft 100 is pivotably coupled to link 102 and link 102 is pivotably coupled to support 104 through axes 110 and 112. Support 104 is coupled to nozzle support 106 which is coupled to nozzle 122. Support 104 is also slidably supported by linear bearing 118 relative to rim heater base 128. Eccentric shaft 100, link 102, support 104 and linear bearing 118 make up a slider-crank mechanism whereby rotational motion of eccentric shaft 100 causes support 104, support 106 and nozzle 122 to reciprocate in the directions indicated by arrows 114 and 116 in a timed relationship with the rotation of turret 22, supporting pockets 24.

Figure 6A:
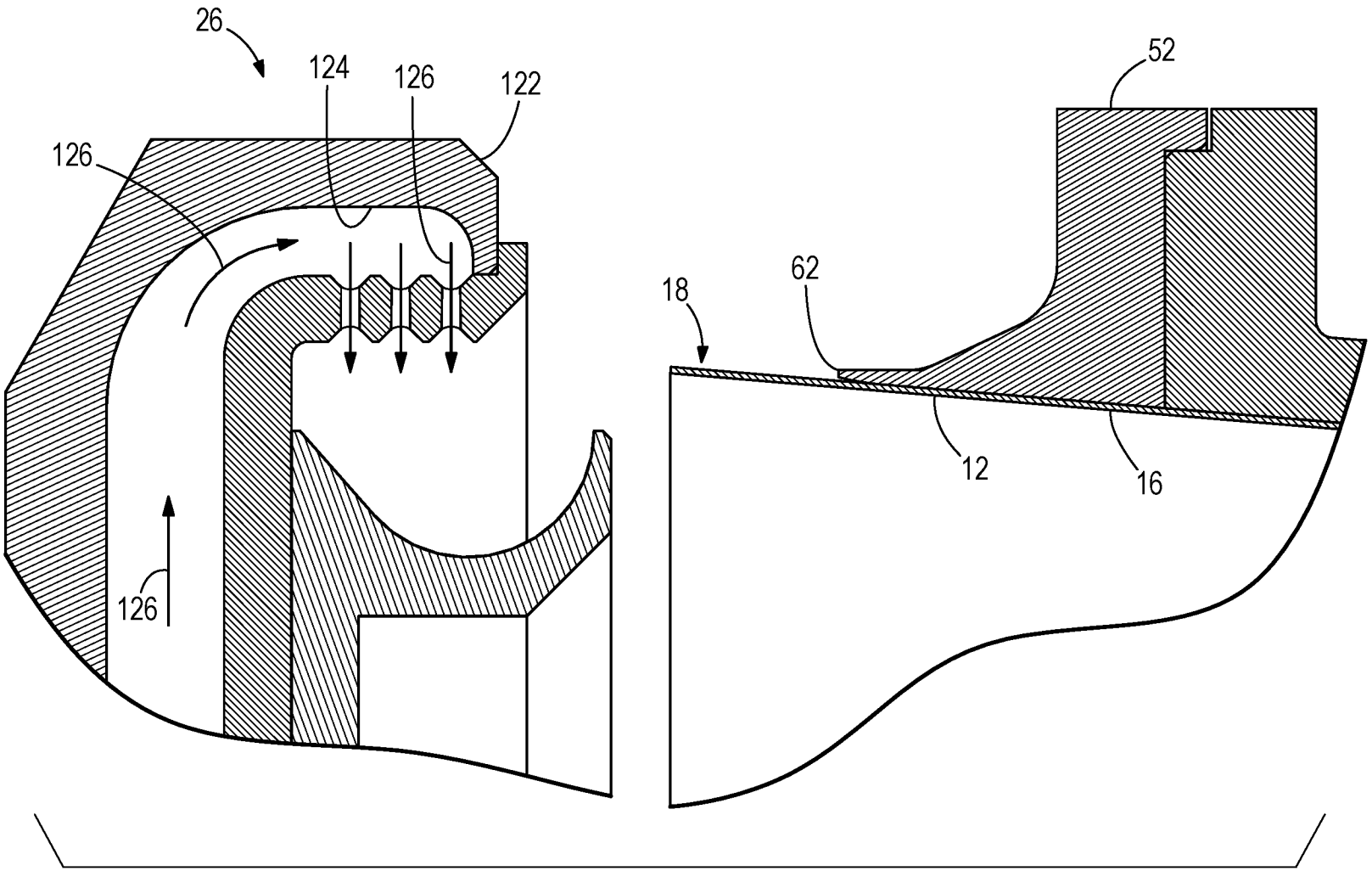
FIG. 6A is an enlarged fragmentary sectional view of the heating station of FIG. 5 in a retracted position relative to a pocket.
Figure 6B:
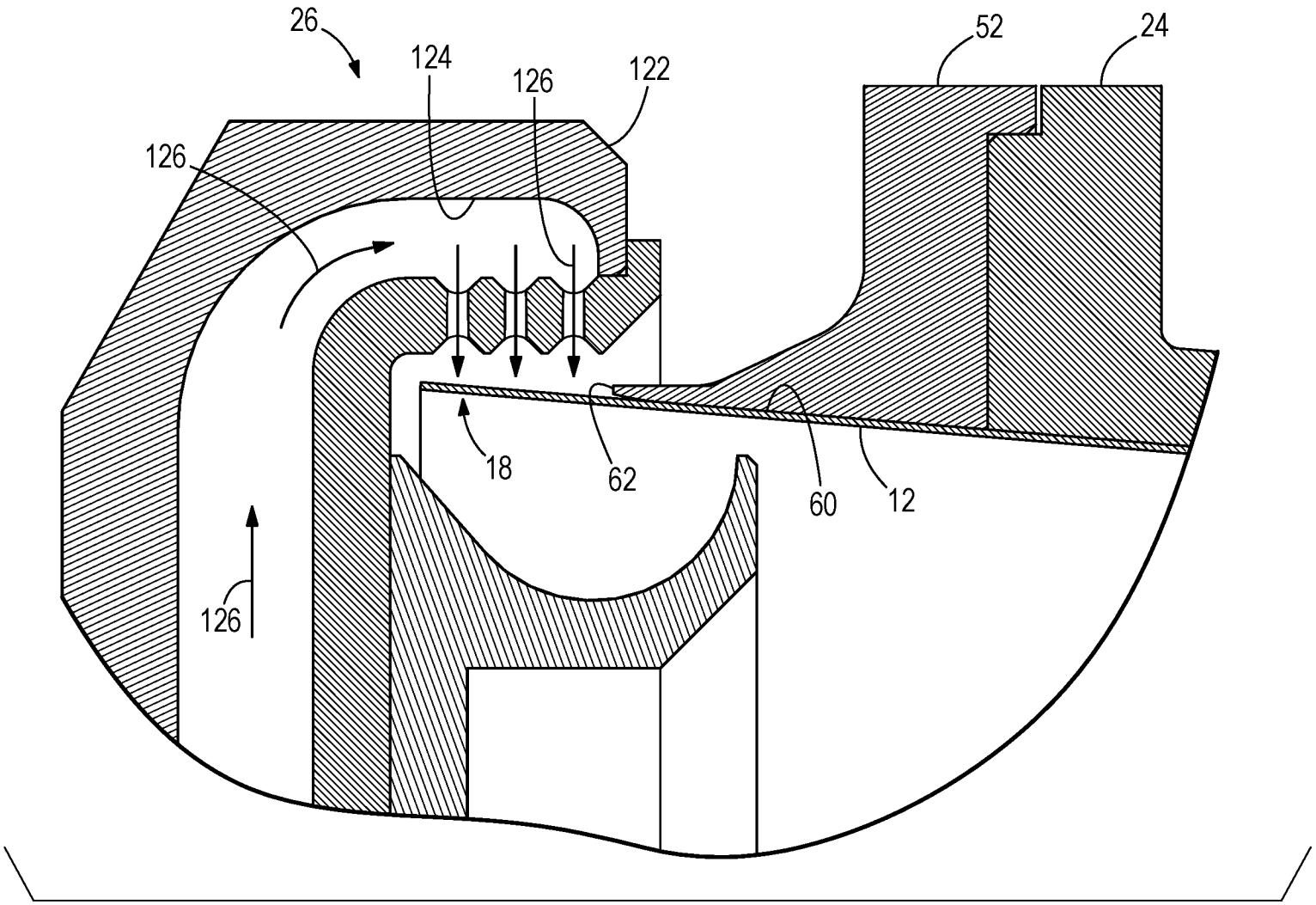
FIG. 6B is an enlarged fragmentary sectional view of the heating station of FIG. 5 in an extended position in which the heating station receives the container carried within a pocket.

Heater assembly 108 is mounted upon rim heater base 128 and generally includes heater 120. Heater 120 is conventionally known and is configured to heat surrounding air which is supplied by a compressor (not shown). The heated air is blown through the internal passageways 124 in the direction indicated by arrows 126 to nozzle 122. As shown by FIGS. 5, 6A, and 6B, nozzle 122 is configured to receive rim 18 of container 12 when pocket 24 is positioned opposite heater station 26 and when support 106 and nozzle 122 have been reciprocated towards pocket 24. As best shown by FIGS. 6A and 6B, nozzle 122 includes internal air passages 124 which direct the heated air from heater 120 onto rim 18 to melt the thermoplastic coating on the paperboard material forming rim 18 and render it more pliable so that it may be more easily curled at curling station 28 and may be sealed at flattening station 30.

Figure 7:
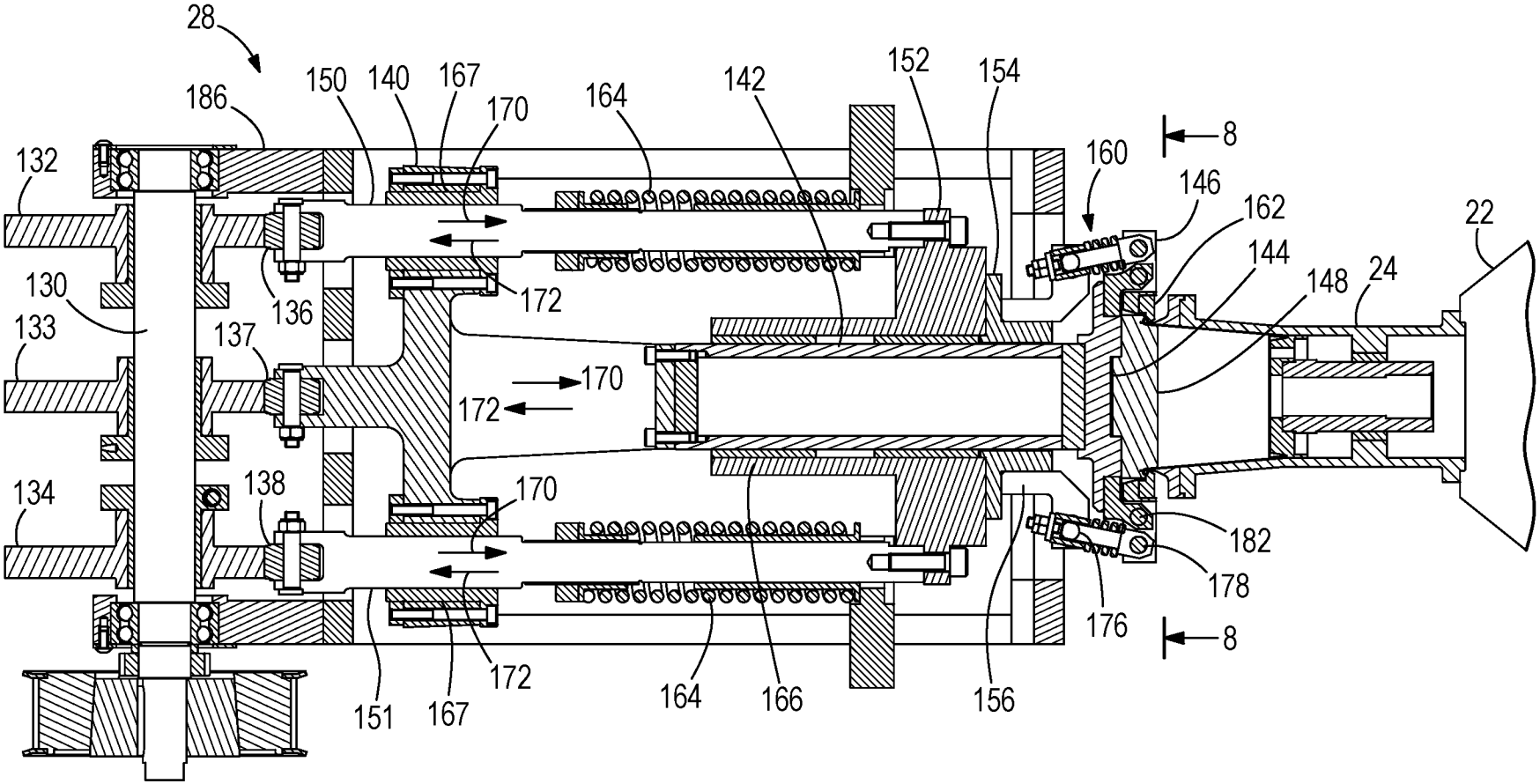
FIG. 7 is a sectional view of the curling station of FIG. 1 taken along line 7-7.
Figure 8:
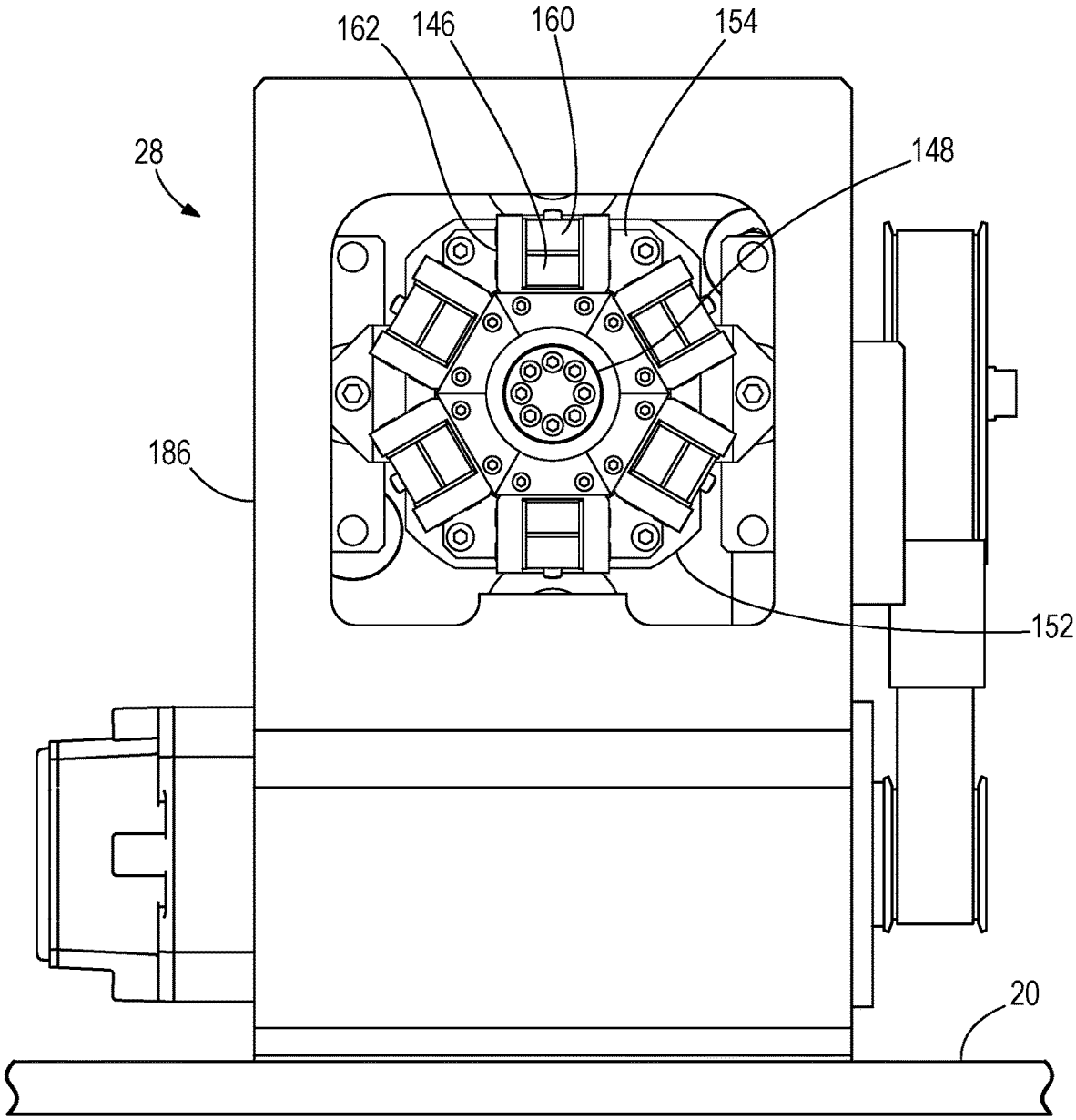
FIG. 8 is a side elevational view of the curling station of FIG. 7 taken along line 8-8.

FIGS. 7-9 illustrate curling station 28 in greater detail. As best shown by FIGS. 7 and 8, curling station 28 generally includes curling station frame 186, drive shaft 130, cams 132, 133, 134, cam followers 136, 137, 138, inner supports 140, 142, 144, 146, forming member 148, outer supports 150, 151, 152, 154, 156, fingers 160, forming segments 162, springs 164 and bushings 166, 167. Shaft 130 is fixedly coupled to each of cams 132, 133 and 134, and is rotatably driven by chains or belts in a conventionally known manner. Cams 132, 133 and 134 are eccentrically mounted upon shaft 130 and interact with cam followers 136, 137 and 138 to reciprocate cam followers 136, 137 and 138 in the directions indicated by arrows 170 and 172 in a timed relationship with the rotation of turret 22, supporting pockets 24.

Cam follower 137 is coupled to inner support 140 which is in turn coupled to support 142. Support 142 is coupled to support 144 which is in turn coupled to supports 146. Support 144 is coupled to forming member 148. In the exemplary embodiment, support 140 is mounted to support 142. Support 142 comprises an elongate cylinder slidably supported by bushing 166 relative to outer support 152. Support 142 is mounted to support 144. Alternatively, each support 140, 142, 144 and 146 may be fixedly secured to one another by any of a variety of mounting mechanisms. Moreover, one or more of supports 140, 142, 144 and 146, as well as a forming member 148, may alternatively be integrally formed with one another to reduce the number of parts or may be provided by a greater number of individual components secured to one another. Springs (not shown) act against support 140 to maintain cam follower 137 against cam 133 during rotation of shaft 130.

Forming member 148 is mounted to support member 144 and includes an annular forming surface 174 (FIGS. 9A-9C) that generally faces pocket 24 when pocket 24 is opposite curling station 28. In the exemplary embodiment, forming surface 174 comprises a concave surface to facilitate curling of rim 18 of container 12. In one preferred embodiment, forming member 148 additionally includes a pancake heater (not shown) between forming member 148 and support 144. The pancake heater heats forming member 148 to better facilitate curling of rim 18 by forming surface 174. Although forming surface 174 preferably is annular in shape, forming surface 174 may alternatively have other continuous shapes depending upon the shape of the container and the rim being formed. For example, forming surface 174 may have non-circular shapes such as oval or general rectangular shapes.

Cam followers 136 and 138 are rotatably coupled to supports 150 and 151 which are coupled to support 152. Support 152 is coupled to support 154 which is coupled to supports 156. Supports 156 are pivotably coupled to each of fingers 160 which are in turn pivotably coupled to each of forming segments 162. Forming segments 162 are also pivotably coupled to supports 146. As shown by FIG. 7, supports 150 and 151 comprise elongate cylinders slidably supported by bushings 167 relative to outer support 140. Supports 150 and 151 are mounted to support 152. Support 152 is mounted to support 154 and support 154 is mounted to supports 156. Support 152 is coupled to bushings (not shown) which are slidably connected to curling station frame 186. Springs 164 act against supports 150 and 151 to maintain cam followers 136 and 138 against cams 132 and 134 during rotation of shaft 130.

Figure 9A:
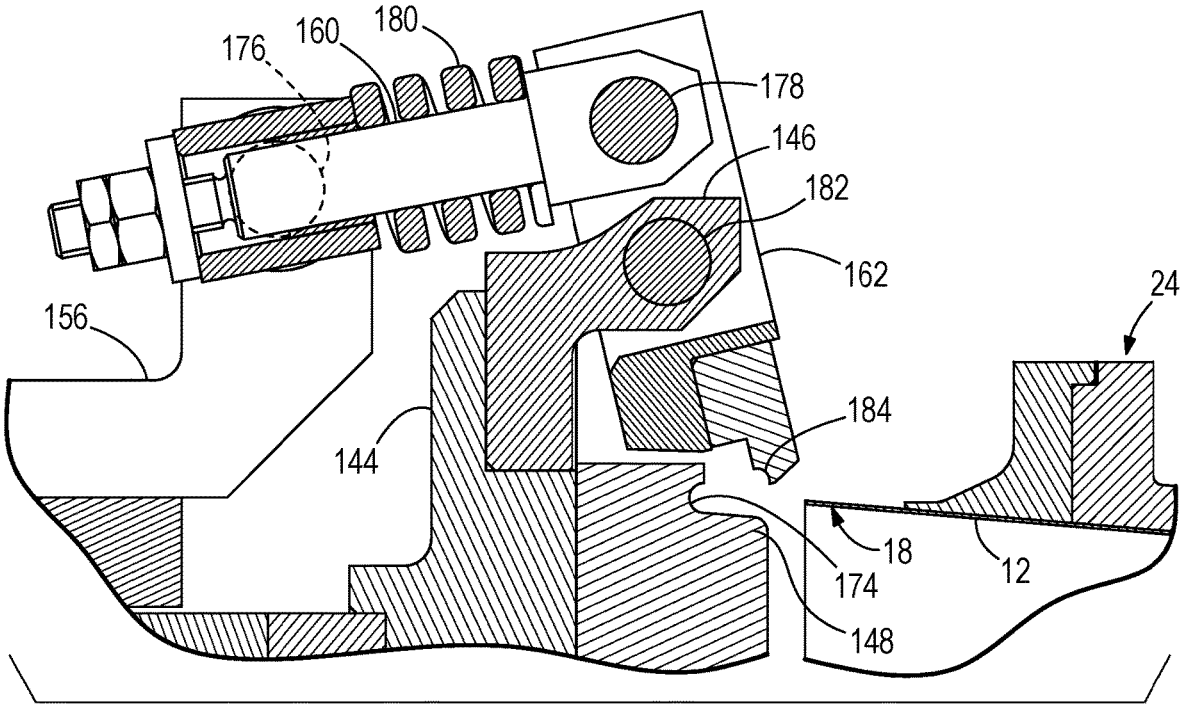
FIG. 9A is an enlarged fragmentary sectional view of forming members of the curling station and pocket of the machine of FIG. 1 with the curling station in an open position and retracted away from a container positioned within a pocket.
Figure 9B:
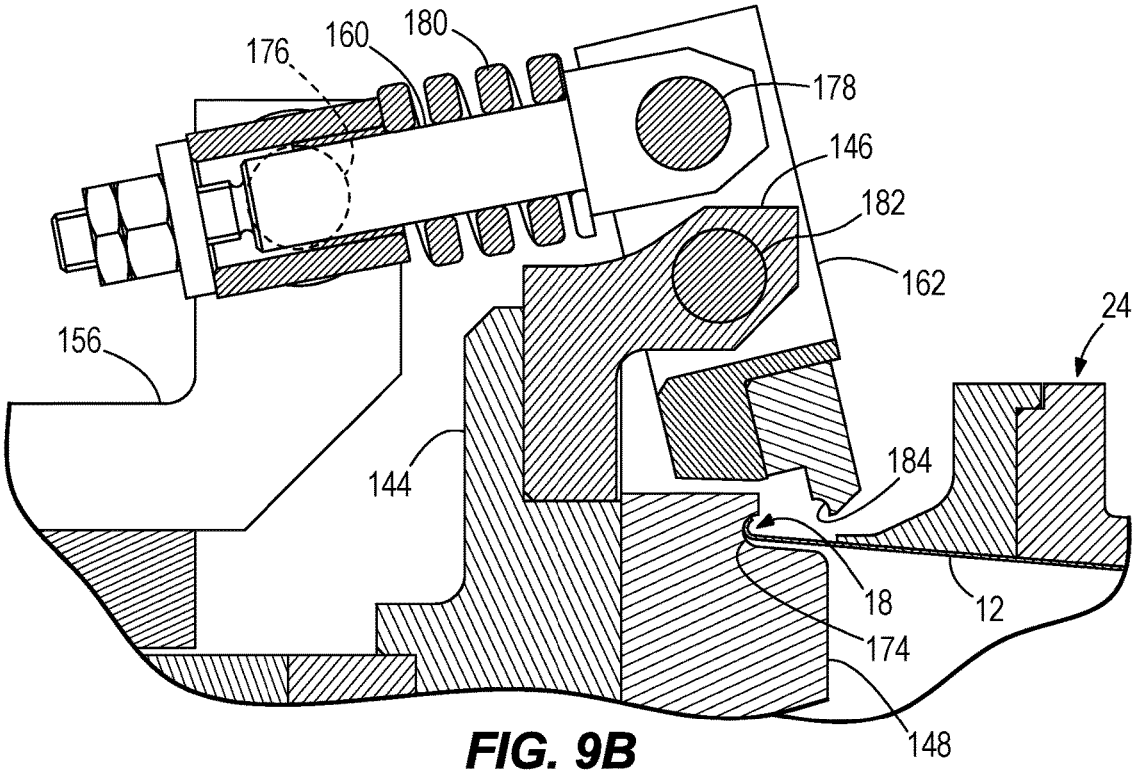
FIG. 9B illustrates the forming members of the curling station of FIG. 9A in an open position and extended into engagement with the container in the pocket.
Figure 9C:
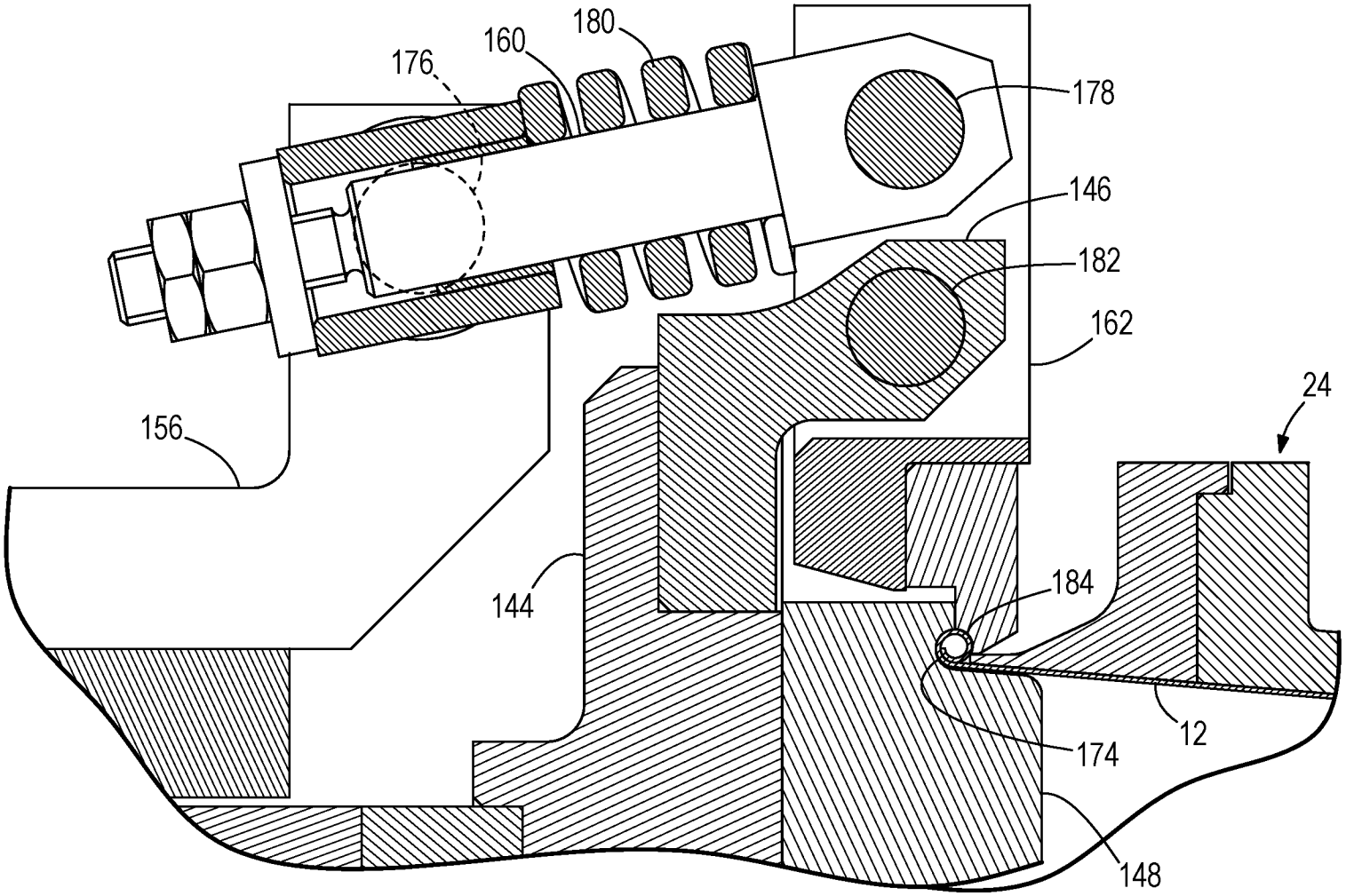
FIG. 9C illustrates the forming members of the curling station of FIG. 9A in a closed position while curling a rim of the container positioned within the pocket.

Fingers 160 extend between support 156 and forming segments 162 and are pivotably coupled to support 156 about axes 176 and also pivotably coupled to forming segments 162 about axes 178. As best shown by FIG. 8, fingers 160 encircle forming member 148. In the exemplary embodiment, curling station 28 includes six such fingers 160 pivotably coupled to six forming segments 162. As will be appreciated, the number of fingers and the number of forming segments may vary depending upon the size and configuration of the container being formed. Referring to FIGS. 9A-9C, each finger 160 preferably has an adjustable length between pivot points 176 and 178 by means of two telescopically mating shafts, wherein the length is generally maintained by a spring 180. Compression spring 180 absorbs any excessive forces acting upon finger 160 to prevent undue damage to curling station 28.

Each forming segment 162 comprises a generally arcuate segment having a forming surface 184. Forming segments 162 circumscribe generally the entire perimeter of forming member 148 and are pivotably coupled to fingers 160 about axes 178 and are further pivotably coupled to support members 146 about axes 182. Actuation of fingers 160 towards and away from pocket 24 by cam followers 136 and 138 pivots each of forming segments 162 in unison between an open position (shown in FIG. 9A) and a closed position (shown in FIG. 9C). In the closed position, each forming surface 184 generally faces the forming surface 174 to form rim 18 therebetween. In the exemplary embodiment, surfaces 174 and 184 are both concave so as to curl rim 18. In an alternative embodiment, surfaces 174 and 184 may be flat so as to alternatively flatten rim 18.

FIGS. 9A-9C illustrate the forming of rim 18 by surfaces 174 and 184 in greater detail. FIG. 9A illustrates forming member 148 and fingers 160 in a retracted position (i.e., pulled back in a direction away from pocket 24). As a result, forming segment 162 is pivoted about axis 182 to the open position. FIG. 9B illustrates forming member 148 being moved towards pocket 24 and into engagement with container 12 as a result of shaft 130 rotating cams 132, 133 and 134 against cam followers 136, 137 and 138 respectively. As a result, forming surface 174 forms rim 18 to partially curl rim 18. As shown by FIG. 9C, further rotation of shaft 130 continues to rotate cams 132, 133 and 134 against cam followers 136, 137 and 138, respectively, so as to move forming member 148 further towards pocket 24 and so as to also move fingers 160 towards pocket 24 such that forming segments 162 pivot to the closed position. As a result, forming surfaces 174 and 184 engage generally opposite sides of the partially curled rim 18 to completely curl rim 18 approximately 360 degrees. Thereafter, continued rotation of shaft 130 rotates cams 132, 133 and 134 against cam followers 136, 137 and 138, respectively, such that forming member 148 is withdrawn away from pocket 24 and such that fingers 160 are also withdrawn away from pocket 24. As a result, forming segments 162 are once again pivoted to the open position away from pocket 24, whereby curling station 28 is ready to once again form a successive container 12 appropriately positioned opposite curling station 28.

Figure 10:
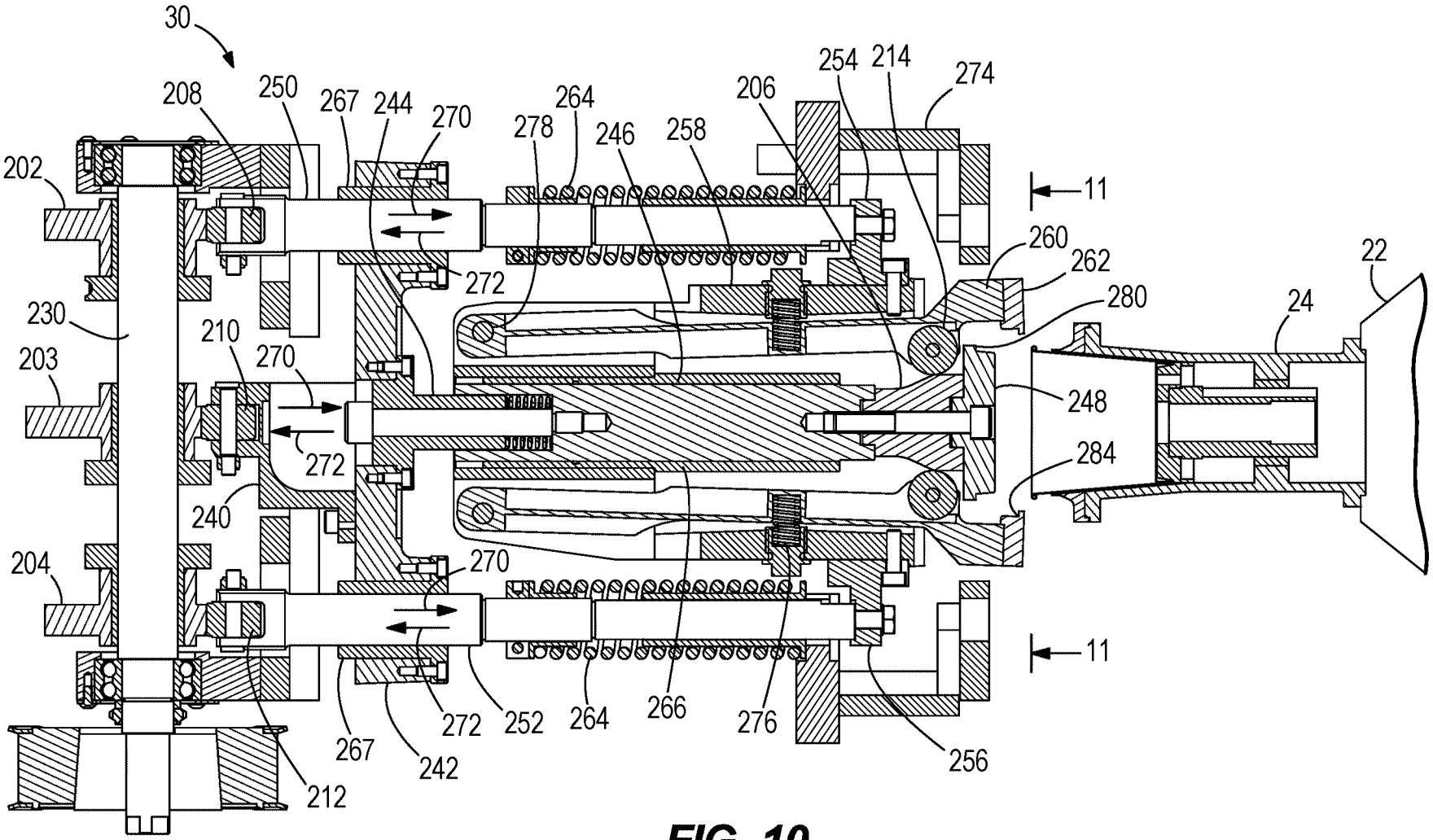
FIG. 10 is a sectional view of the flattening station of FIG. 1 taken along line 10-10.
Figure 11:
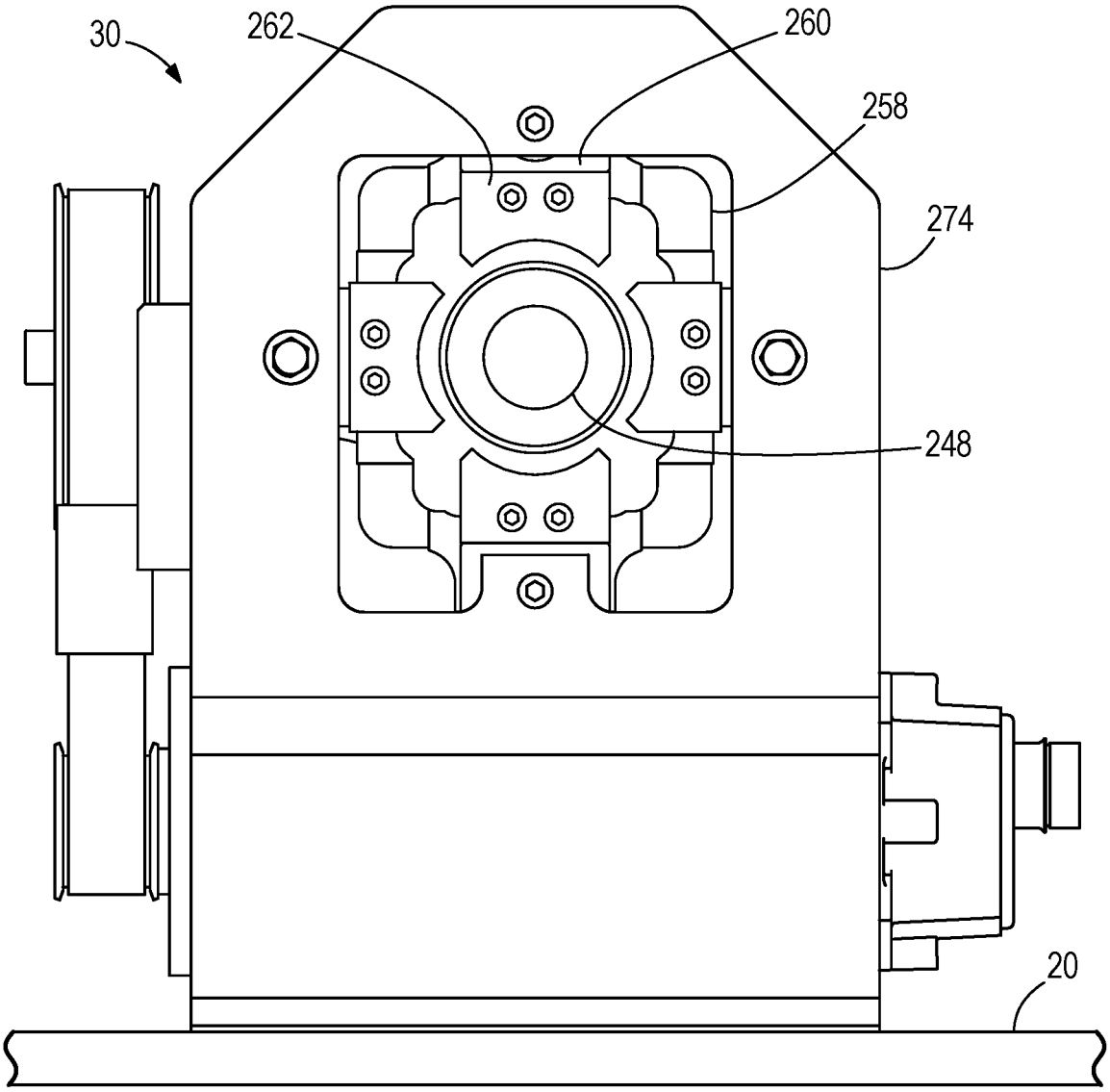
FIG. 11 is a side elevational view of the flattening station of FIG. 10 taken along line 11-11.

FIGS. 10-12 illustrate flattening station 30 in greater detail. As best shown by FIGS. 10-12, flattening station 30 generally includes flattening station frame 274, shaft 230, cams 202, 203, 204, 206 cam followers 208, 210, 212, 214, inner supports 240, 242, 244, 246, forming member 248, outer supports 250, 252, 254, 256, 258 forming arms 260, forming segments 262, springs 264, 276 and bushings 266, 267. Shaft 230 is fixedly coupled to each of cams 202, 203 and 204 and is rotatably driven by chains or belts in a conventionally known manner. Cams 202, 203 and 204 are eccentrically mounted upon shaft 230 and interact with cam followers 208, 210 and 212 to reciprocate cam followers 208, 210 and 212 in the directions indicated by arrows 270 and 272 in a timed relationship with the rotation of turret 22 supporting pockets 24.

Cam follower 210 is coupled to inner support 240 which is in turn coupled to support 242. Support 242 is coupled to support 244 which is in turn coupled to support 246. Support 246 is coupled to cam 206. Cam 206 is coupled to forming member 248. In the exemplary embodiment, support 240 is mounted to support 242. Support 242 is mounted to support 244. Support 244 is mounted to support 246. Support 246 comprises an elongate cylinder slidably supported by bushing 266 relative to outer support 258. Support 246 is mounted to cam 206. Cam 206 is mounted to a forming member 248. Alternatively, each support 240, 242, 244 and 246 may he fixedly secured to one another by any of a variety of mounting mechanisms. Moreover, one or more of supports 240, 242, 244 and 246, as well as cam 206 and forming member 248, may alternatively be integrally formed with one another to reduce the number of parts or may be provided by a greater number of individual components secured to one another. Springs (not shown) act against support 242 to maintain cam follower 210 against cam 203 during rotation of shaft 230.

Forming member 248 is mounted to cam 206 and includes an annular forming surface 280 that generally faces pocket 24 when pocket 24 is opposite flattening station 30. In the exemplary embodiment, forming surface 280 comprises a flat surface to facilitate flattening of rim 18 of container 12. Although forming surface 280 preferably is flat in shape, forming surface 280 may alternatively have other continuous shapes depending upon the shape of the container and the rim being formed. For example, surface 280 may have round shapes or noncircular shapes such as oval.

Cam followers 208 and 212 are rotatably coupled to supports 250 and 252 which are coupled to supports 254 and 256 which are coupled to support 258. Support 258 is pivotably coupled to each of the forming arms 260. Forming segments 262 are coupled to forming arms 260. As shown by FIG. 10, supports 250 and 252 comprise elongate cylinders slidably supported by bushings 267 relative to outer support 242. Supports 250 and 252 are mounted to supports 254 and 256. Supports 254 and 256 are mounted to support 258. Springs 264 act against supports 250 and 252 to maintain cam followers 208 and 212 against cams 202 and 204 during rotation of shaft 230. Support 258 is coupled to bushings (not shown) which are slidably connected to flattening station frame 274.

Cam followers 214 are rotatably coupled to forming arms 260. Cam 206 interacts with cam followers 214 to pivot forming arms 260 about axis 278. Springs 276 act against forming arms 260 to maintain cam followers 214 against cam 206 during activation of cam 206. As best shown by FIG. 11, forming arms 260 and forming segments 262 encircle forming member 248. In the exemplary embodiment, flattening station 30 includes four such forming arms 260 coupled to four forming segments 262. As will be appreciated, the number of forming arms and the number of forming segments may vary depending upon the size and configuration of the container being formed.

Each forming segment 262 comprises a generally flat segment having a forming surface 284. Forming segments 262 circumscribe generally the entire perimeter of forming member 248 and are coupled to forming arms 260 which are pivotably coupled to support 258 about axes 278. Actuation of forming arms 260 towards and away from pocket 24 by cam followers 208 and 212 and the reciprocation of cam 206 acting on cam follower 214, pivots each of forming segments 262 in unison between an open position (shown in FIG. 12A) and a closed position (shown in FIG. 12C). In the closed position, each forming surface 284 generally faces the forming surface 280 to form rim 18 therebetween. In the exemplary embodiment, surfaces 280 and 284 are both flat so as to flatten rim 18. In an alternative embodiment, surfaces 280 and 284 may be curved.

Figure 12A:
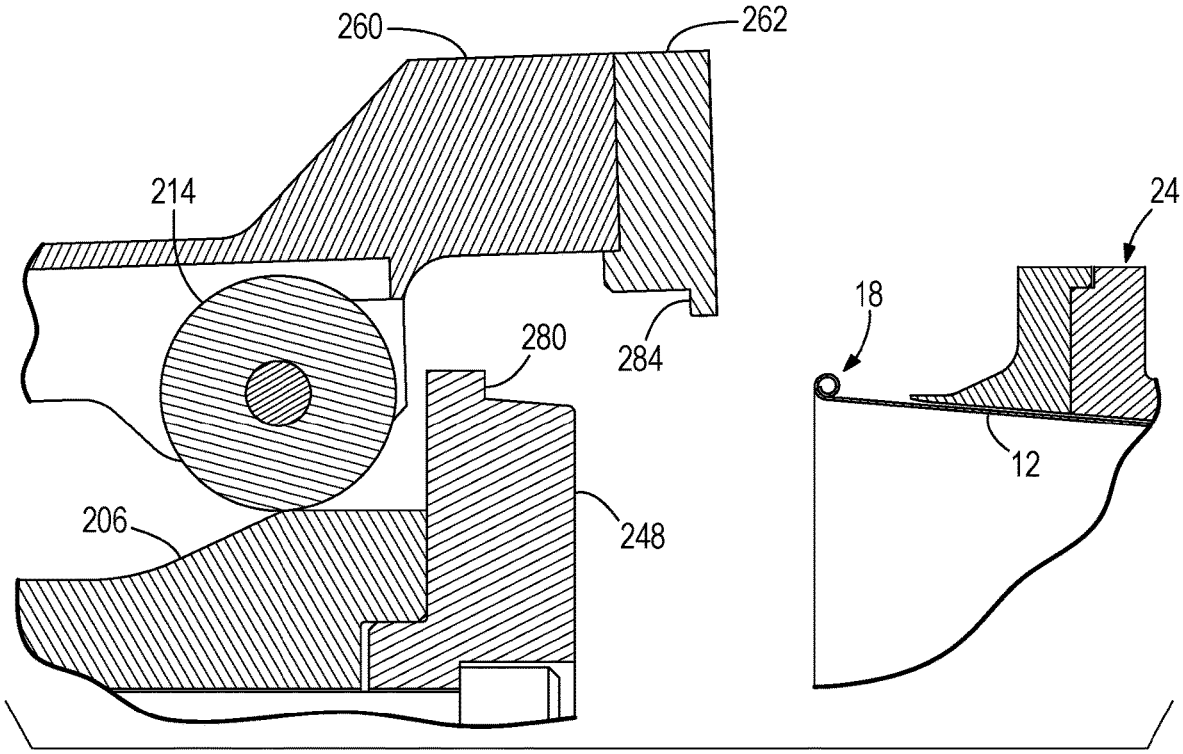
FIG. 12A is an enlarged fragmentary sectional view of the flattening station and pocket of the machine of FIG. 1 supporting a container having a curled rim, wherein the container is in the extended position and flattening station is in the retracted position.
Figure 12B:
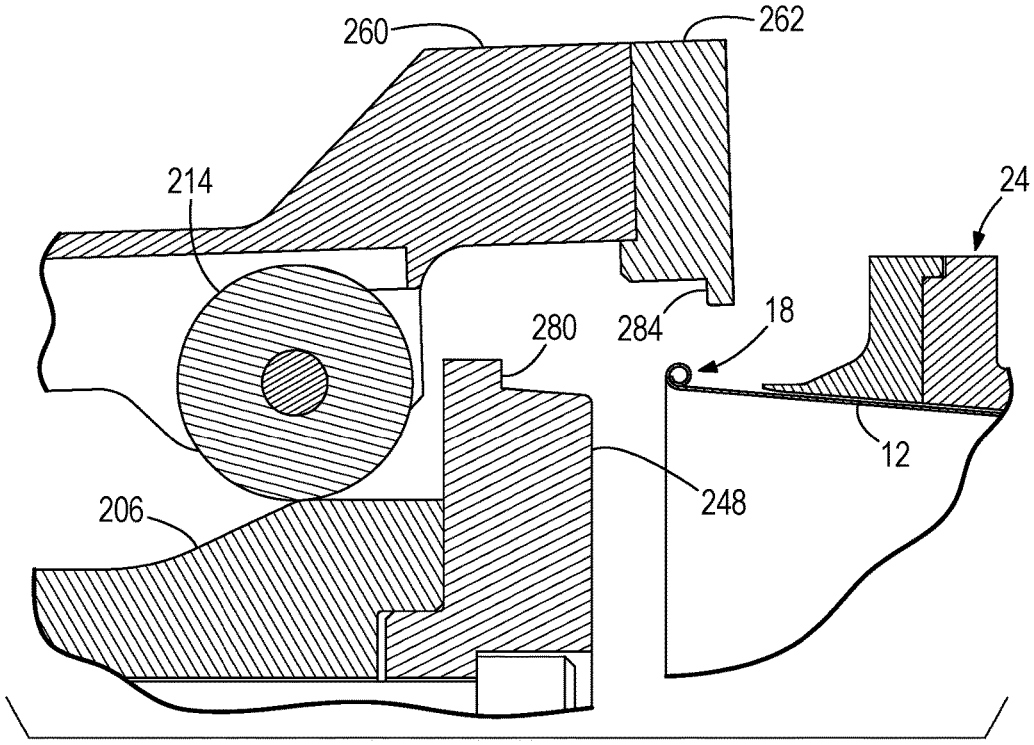
FIG. 12B illustrates the flattening station, pocket and container of FIG. 12A with the die segments in the full forward position.
Figure 12C:
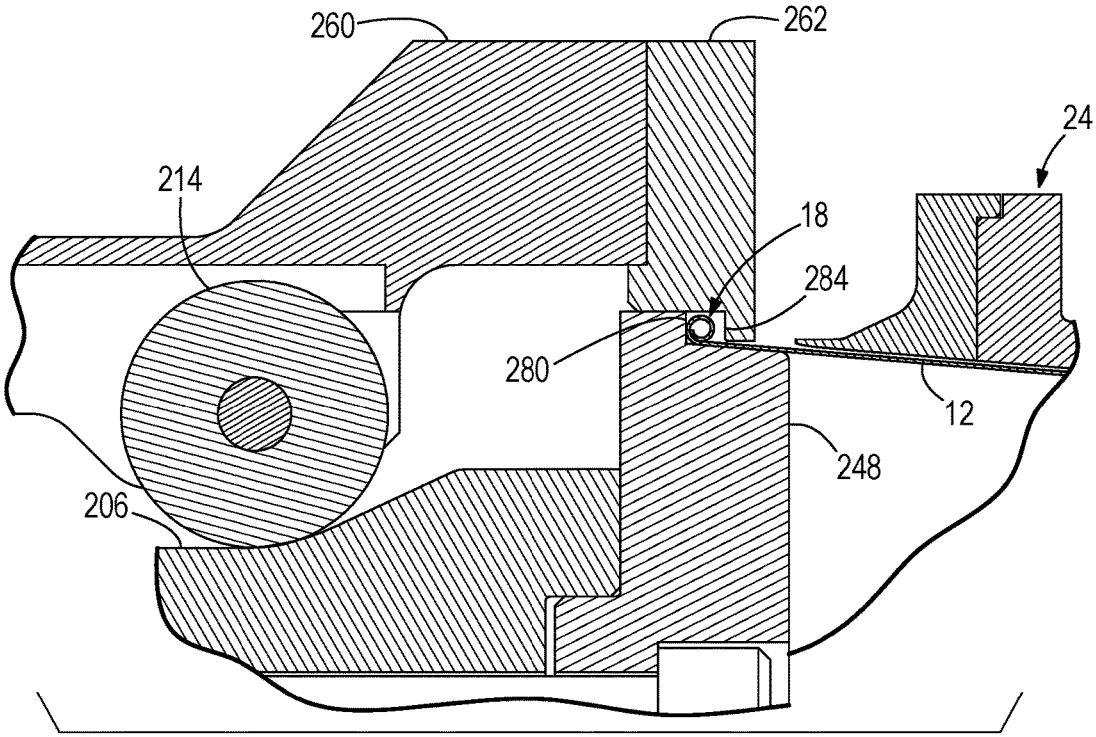
FIG. 12C illustrates the flattening station, pocket and container of FIG. 12A with forming member in the full forward position and the die segments fully closed.
Figure 12D:
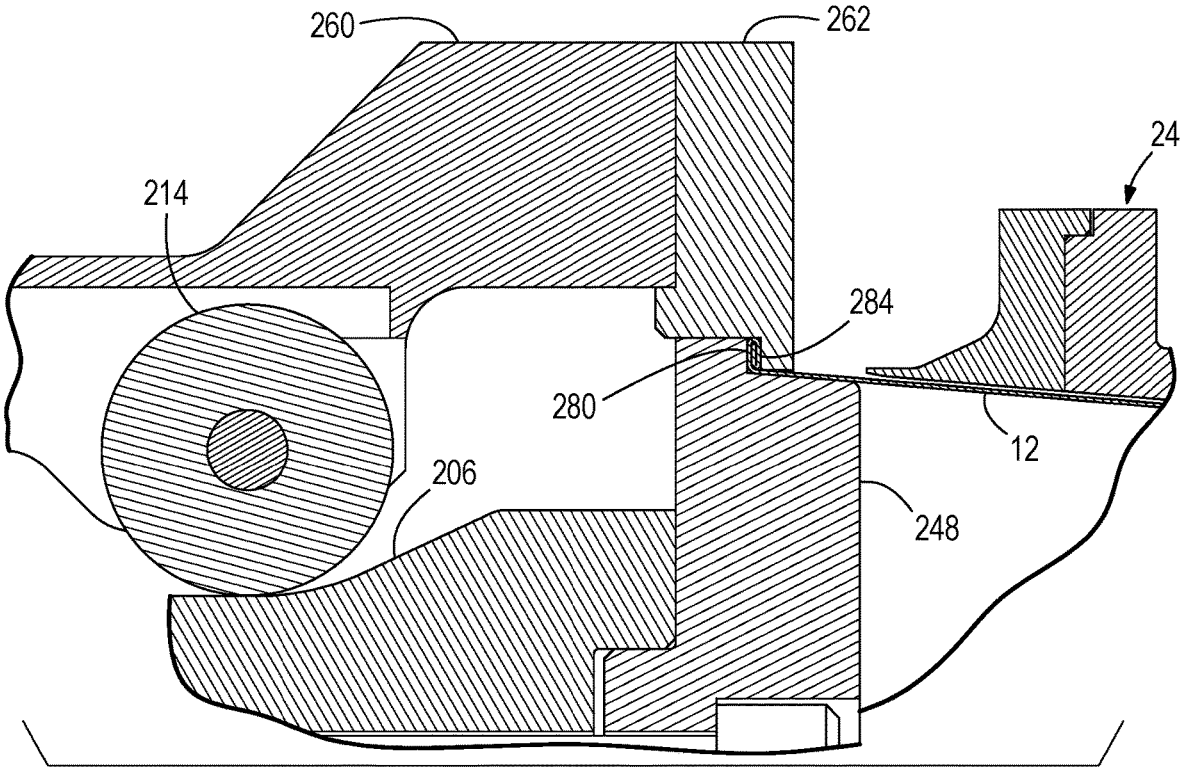
FIG. 12D illustrates the flattening station, pocket and container of FIG. 12A with forming member in the full forward position and the die segments retracted to the forming member so as to compress and flatten the curled rim between the forming member and die segments of the flattening station.

FIGS. 12A-12D illustrate the forming of rim 18 by forming surfaces 280 and 284 in greater detail. FIG. 12A illustrates forming arms 260 and forming member 248 in a retracted position (i.e., pulled back in a direction away from pocket 24). As a result, forming arms 260 are pivoted about axes 278 to the open position. The left-hand section of FIG. 2 illustrates shell bottom 56 being moved outward toward mouth 62 pushing container 12 out of the pocket 24 as a result of turret 22 rotating cam follower 76 against cam 78. As a result, container 12 is now in a position where the flattener station 30 can now flatten curled rim 18. FIG. 12B illustrates forming members 248 and 262 being moved towards pocket 24 as a result of shaft 230 rotating cams 202, 203 and 204 against cam followers 208, 210 and 212, respectively. Forming members 262 now stop their forward travel. As shown by FIG. 12C, further rotation of shaft 230 continues to rotate cams 202, 203 and 204 against cam followers 208, 210 and 212, respectively, so as to move forming member 248 further towards pocket 24 until forming surface 280 touches curled rim 18. As a result, cam followers 214, on forming arms 260, follow the cam surface on cam 206 causing the forming arms 260 and forming members 262 to pivot about axes 278 closing forming members 262 around rim 18. Thereafter, continued rotation of shaft 230 rotates cams 202, 203 and 204 against cam followers 208, 210 and 212, respectively, such that forming member 262 moves outwardly from pocket 24 so that forming surface 284 engages the curled rim 18. As a result, rim 18 is captured between surfaces 280 and 284 and is compressed or flattened as depicted in FIG. 12D. Afterwards, continued rotation of shaft 230 retracts forming members 248 and 262 away from pocket 24 and turret 22 rotates pocket 24 to the next station, thereby positioning the next successive pocket carrying the curled, but unflattened rim 18 across from flattening station 30.

Figure 13:
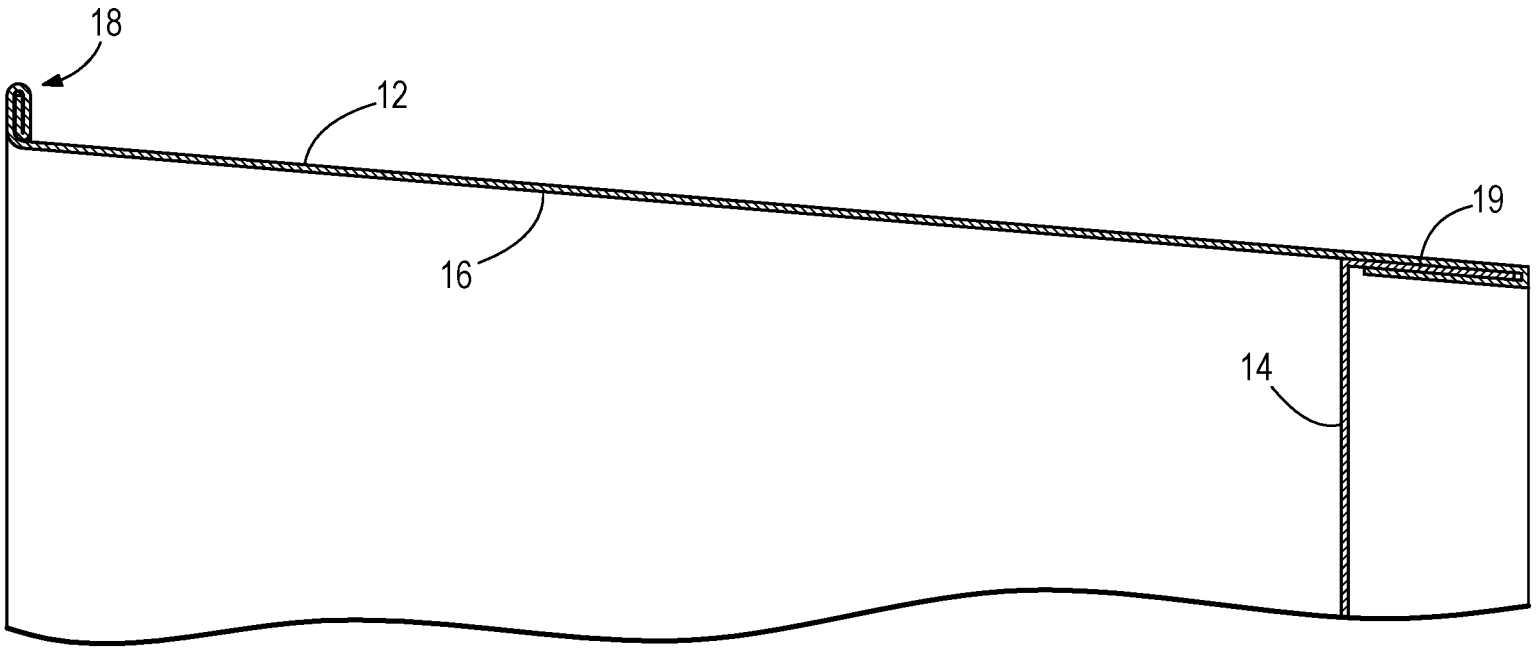
FIG. 13 is a fragmentary sectional view of the resulting container worked upon by the apparatus of FIGS. 1-12 and including a curled and flattened rim.

FIG. 13 is a fragmentary sectional view of container 12 after the rim 18 has been curled and flattened by apparatus 10. As best seen in FIG. 13, flattening station 30 compresses and flattens rim 18 such that the rim 18 is generally flat along both its upper and lower surfaces. Because rim 18 is not only flattened on both sides but is also compressed, any step along the seam of the paperboard material is minimized. As a result, the seal between the sealing panel typically positioned across the opening of container 12 and sealed to the flat upper surface of rim 18 is more reliable and less susceptible to damage.

Although the present invention has been described with reference to preferred embodiments, workers skilled in the art will recognize that changes may be made in form and detail without departing from the spirit and scope of the invention as set forth in the appended claims.

What is claimed is:

1. An apparatus for forming an upper edge of a paperboard container having a bottom and a sidewall terminating at a rim at the upper edge, the apparatus comprising:

a pocket including a shell having a cavity with a mouth to receive the container such that the rim extends beyond the mouth and the container is centered along an axis of the pocket, the rim being formed with a curl thereon; and a flattening station to provide compression and flattening of the curl formed on the rim, the flattening station including a support including a cam and a forming member mounted to the cam, the forming member having a first forming surface and the cam including an inclined cam surface formed on an exterior surface of the cam, wherein the support including the cam and the forming member are moveable together back and forth relative to the container along the axis of the pocket; and a set of forming arms pivotally coupled to the support and positioned outside the forming member for movement relative to the forming member, the forming arms being axially moveable together with the support including the cam and the forming member, the support being movable from a retracted position to an extended position, each of the forming arms having a cam follower in the form of a roller engaged with the inclined surface of the cam and a forming segment having a second forming surface facing the first forming surface, wherein when the support and the forming member are moved longitudinally along the axis of the pocket from the extended position to a first position, each of the forming arms moves longitudinally with the support, wherein upon further longitudinal movement of the support from the first position the roller of each forming arm moves along the inclined cam surface, wherein the forming arms pivot to move toward each other from an open position in which the forming member and each forming segment are spaced from each other to a closed position to position each second forming surface adjacent to a lower end of the curl on the rim, wherein in response to further axial movement of the support, the roller of each forming arm moves off of the inclined cam surface and the first forming surface moves axially toward each second forming surface to form a flattened rim on the container.

2. The apparatus of claim 1, wherein the first forming surface is a flat surface and the second forming surface is a flat surface.

3. The apparatus of claim 1, wherein a heating station is to heat the rim prior to the rim being formed with a curl.

4. The apparatus of claim 3, wherein a curling station is positioned between the heating station and the flattening station and is to form the curl on the rim.

5. The apparatus of claim 4, wherein the curling station includes a pair of cooperating concave forming surfaces to form the curl on the rim.

* * * * *